US008517627B2

(12) United States Patent
Myers

(10) Patent No.: US 8,517,627 B2
(45) Date of Patent: Aug. 27, 2013

(54) METHOD OF PLACING VISIBLE ADVERTISING

(75) Inventor: Caleb Myers, East Sydney (AU)

(73) Assignee: Rhino Advertising Pty Limited, East Sydney, New South Wales (AU)

( * ) Notice: Subject to any disclaimer, the term of this patent is extended or adjusted under 35 U.S.C. 154(b) by 0 days.

(21) Appl. No.: 13/495,122

(22) Filed: Jun. 13, 2012

(65) Prior Publication Data

US 2012/0251240 A1 Oct. 4, 2012

Related U.S. Application Data

(63) Continuation of application No. 12/783,213, filed on May 19, 2010, now abandoned, which is a continuation of application No. 12/060,667, filed on Apr. 1, 2008, now abandoned, which is a continuation of application No. 11/737,874, filed on Apr. 20, 2007, now abandoned, which is a continuation of application No. 10/505,081, filed as application No. PCT/AU03/00227 on Feb. 20, 2003, now abandoned.

(30) Foreign Application Priority Data

Feb. 20, 2002 (AU) ..... PS0658

(51) Int. Cl.
*E01C 23/20* (2006.01)

(52) U.S. Cl.
USPC ..... 404/72; 40/612

(58) Field of Classification Search
CPC ..... E01F 9/08
USPC ..... 404/93, 94, 6, 9–16; 40/612; 340/907
See application file for complete search history.

(56) References Cited

U.S. PATENT DOCUMENTS

| | | | | |
|---|---|---|---|---|
| 1,732,869 | A | 10/1929 | Wambach | 40/615 |
| 1,830,319 | A | 11/1931 | Hartzler et al. | 404/10 |
| 2,503,574 | A | 4/1950 | Allen | 40/565 |
| 3,188,927 | A | 6/1965 | Woods | 404/9 |
| 3,626,896 | A | 12/1971 | Preeshl | 116/33 |

(Continued)

FOREIGN PATENT DOCUMENTS

| | | |
|---|---|---|
| AU | 2001100126 | 8/2001 |
| CA | 2276943 | 1/2001 |

(Continued)

OTHER PUBLICATIONS

Awdal Roads Building Company, 2001 (web pages found at ,www.awdal.com/plan/arbc/html).

(Continued)

*Primary Examiner* — Raymond W Addie
(74) *Attorney, Agent, or Firm* — Fitzpatrick, Cella, Harper & Scinto

(57) ABSTRACT

A preferred embodiment of the invention provides a method of placing visible advertising on the upper surface of a road (1). This method includes determining the location of any traffic control signs that are applied to the surface of the road, such as the location of signs (22, 25). Following from this, two exclusion zones (31, 32) are defined. These zones extend from the respective signs (22, 25) and terminate at a predetermined minimum distance from the signs. Advertising is then applied to the surface such that it overlies neither the signs nor the exclusion zones. Particularly, the advertising has been placed in the areas bounded by rectangles (33, 34), which are respectively disposed within lanes (7, 8).

15 Claims, 9 Drawing Sheets

(56) References Cited

U.S. PATENT DOCUMENTS

| | | | | |
|---|---|---|---|---|
| 4,440,521 | A | 4/1984 | Gebelius | 404/72 |
| 5,021,476 | A | 6/1991 | Pinomaa | 524/77 |
| 5,035,531 | A | 7/1991 | Sanchez | 404/12 |
| 5,150,116 | A | 9/1992 | West | 340/928 |
| 5,507,589 | A | 4/1996 | Jacobs | 404/11 |
| 5,947,635 | A | 9/1999 | Wilson, Sr. | 404/72 |
| RE36,930 | E | 10/2000 | Houten et al. | 340/944 |
| 6,444,077 | B1 | 9/2002 | Fennessy | 156/249 |
| 6,524,412 | B2 | 2/2003 | Smith | 156/71 |
| 6,576,074 | B1 | 6/2003 | Cabrera et al. | 156/71 |
| 6,914,540 | B2 | 7/2005 | Gongolas | 340/908.1 |

FOREIGN PATENT DOCUMENTS

| | | | |
|---|---|---|---|
| CN | 1097518 | A | 1/1995 |
| CN | 1227377 | A | 9/1999 |
| CN | 1296700 | A | 5/2001 |
| CN | 1319838 | A | 10/2001 |
| CN | 1357869 | | 7/2002 |
| DE | 2833709 | | 7/1980 |

OTHER PUBLICATIONS

Traffic Engineering Manual, pp. 9-1 and 9-56, Jul. 1, 2000 (found at .www.dot.state.mn.us/trafficeng/otepibl/tem/Chap-9-2000.pdf).

METHOD OF PLACING VISIBLE ADVERTISING

CROSS REFERENCE TO RELATED APPLICATIONS

This application is a continuation of U.S. patent application Ser. No. 12/783,213, filed on May 19, 2010, which is a continuation of U.S. patent application Ser. No. 12/060,667, filed on Apr. 1, 2008, which is a continuation of U.S. patent application Ser. No. 11/737,874 filed on Apr. 20, 2007, which is a continuation of U.S. application Ser. No. 10/505,081 filed on Aug. 19, 2004, which is a national stage of International Application No. PCT/AU03/00227 filed on Feb. 20, 2003. The entire disclosure of each prior application is incorporated by reference herein.

FIELD OF THE INVENTION

The present invention relates to advertising and in particular to a method of placing visible advertising.

The invention has been developed primarily to subsidise road maintenance and will be described hereafter with reference to that application. However, it will be appreciated that the invention is not limited to that particular field of use and is also suitable for advertising in general.

BACKGROUND TO THE INVENTION

Advertising is well known and many and varied forms are used to market products and services to target markets. One known form includes road signage such as signs mounted at the side of roads, dedicated billboards, walls of buildings, static and dynamic displays, truck mounted displays and the like.

The use of road signage, however, provides a conundrum. More particularly, the notion of advertising is to preferentially attract the viewer's attention—and in this case, the viewer's gaze—and to create an easily recollected image in the mind of the viewer. However, where that viewer is most likely to be in control of a motor vehicle, it is not conducive to safety for the viewer's attention to be other than predominantly centred upon the progress of the vehicle. It follows that the more effective the advertising is at achieving its end, the more likely it will contributes to distracting drivers from the key responsibility they have at the time. Additionally, the advertising itself can often obscure a driver's field of view, and/or create a collision hazard to a vehicle that inadvertently veers off the road.

A further disadvantage of existing advertisements is that the information is not accessible in a majority of conditions. While a portion of the viewers of an advertisement may have ample opportunity to locate and read roadside advertising in daylight hours in agreeable weather conditions, a large portion of the viewing population does not. Likewise, even if roadside advertising is noticed in darkness, it is difficult to discern the relevant information with a sufficient degree of accuracy.

In partial answer to these disadvantages it has been known to provide advertising that is illuminated by way of independent lighting, or which makes use of retro-reflective displays. However, this adds to the cost and complexity of the advertisement site. In the case of retro-reflective displays, this is also limited by the observation angle of the retro-reflective material used. This, in turn, limits such displays to locations where the light from the vehicles and the placement of the display are such that a useful result will be achieved.

Road signage can also be seen as aesthetically displeasing and obtrusive, particularly to those who live near such signage. This is particularly the case with large dedicated billboard, which generally require considerable support structures.

Any discussion of the prior art throughout the specification should in no way be considered as an admission that such prior art is widely known or forms part of common general knowledge in the field.

BRIEF DISCLOSURE OF THE INVENTION

It is an object of the present invention to overcome or ameliorate one or more of the deficiencies of the prior art, or at least to provide a useful alternative.

According to a first aspect of the invention there is provided a method of placing visible advertising on a surface of a road, the method including:

determining the location of one or more traffic control signs that are applied to the surface of the road;

defining exclusion zones that extend from the respective signs and which terminate at a predetermined minimum distance from the signs; and applying the advertising to the surface such that the advertising overlies neither the signs nor the exclusion zones.

Preferably, the road is subject to a maximum speed limit and the method includes the step of calculating predetermined minimum distance in response to that limit.

According to a second aspect of the invention there is provided a method of selecting a portion of a road lane for placing visible advertising, the method including:

determining a direction of travel of traffic along the lane;

determining the location of two consecutive decision zones along the lane, wherein the zones are spaced apart in the direction of travel to define an upstream zone and a downstream zone;

defining a lead zone that extends from the downstream zone toward the upstream zone and that terminates at a first predetermined distance from the downstream zone; and selecting the portion to lie between the upstream zone and the lead zone.

Preferably, method includes:

determining the maximum allowable speed of the traffic along the lane; and being responsive to the maximum allowable speed for calculating the predetermined distance.

Preferably also, to calculate the predetermined distance the method includes multiplying the maximum allowable speed by a constant time factor. More preferably, the time factor is three seconds. In other embodiments, such as for lanes where the maximum allowable speed is high, longer time factors are used.

In a preferred form, method includes:

determining the maximum allowable speed of the traffic along the lane; and being responsive to the maximum allowable speed for calculating a minimum length of the visible advertising in the direction of travel.

Preferably, the method includes the step of defining a trailing zone that extends from the upstream zone toward the downstream zone and that terminates at a second predetermined distance from the upstream zone. More preferably, the first and the second predetermined distances are about equal. In other embodiments, however, the first and the second predetermined distances are not equal. In this event, it is preferred that the first predetermined distance is greater than the second predetermine distance.

Preferably also, the direction of travel is constant. However, in other embodiments the direction of travel varies with time.

In a preferred form, the method includes the step of applying the visible advertising to the selected portion. More preferably, the portion includes a surface and the method includes the step of applying the advertising by modifying the surface. Even more preferably, the method includes modifying the surface by applying to the surface one or more of: a paint; adhesive tape; reflective material; textured material; and light.

Preferably also, the road lane is one of a plurality of coextending like road lanes. However, in other embodiments, the road lane comprises a road.

Preferably, the method includes orientating the visible advertising within the lane for preferential viewing by a user progressing along the lane in the direction of travel. More preferably, the method includes the steps of:

determining a probable perspective that the user is to have of the visible advertising while progressing along the lane in the direction of travel; and prior to the application of the advertising to the portion, adjusting the advertising in response to the probable perspective.

In a preferred form, the decision zones are traffic control signals. More preferably, the signals are applied to the lane. In other embodiments, however, the signals are applied adjacent to the lane. Examples of the latter include traffic control signs such as road side signage and overhead signs such as traffic lights.

According to a third aspect of the invention there is provided a method of selecting portions of a road for placing visible advertising, where the road includes a plurality of lanes, the method including:

selecting a first one of the lanes and carrying out the steps of the second aspect of the invention to select a first portion; and selecting another of the lanes and carrying out the steps of the second aspect of the invention to select a second portion.

Preferably, the first and second portions are adjacent to each other. More preferably, the first and second portions are aligned and contiguous. Even more preferably, the method includes the step of applying an advertisement that overlies both the first and the second portions.

In other embodiments the first and second portions are spaced apart.

Preferably also, the direction of travel in the first one of the lanes is opposite to the direction of travel in the other one of the lanes.

According to a fourth aspect of the invention there is provided a method of placing visible advertising, the method including:

selecting a portion of a road lane in accordance with the second aspect of the invention; and modifying the surface of the portion to provide the visible advertising.

Preferably, the step of modifying the surface includes applying one or more coats of paint to the surface. In other embodiments, that step includes one or more of:

applying a film to the surface; applying light to the surface; embedding material into the surface; and replacing the surface.

Some of the preferred embodiments make use of one or more passive materials that are applied to or which are embedded within the surface to provide light reflective properties for allowing images and indicia to be presented to an occupant of the vehicle. In other embodiments use is made of active devices, such as LEDs embedded in the surface.

Preferably also, the method includes orienting the display in response to the direction of travel.

According to a fifth aspect of the invention there is provided a method of advertising on a road surface, the method including:

obtaining a plurality of advertising information parcels that are indicative of corresponding visual advertisements from one or more parties;

obtaining order information from the or each party for placement of the visual advertisements;

defining a plurality of zones on the surface for receiving respective advertisements;

categorising each zone by one or more of the following criterion: location; size; maximum allowable speed; time period; and premium;

allocating the parcels to the zones in response to the categorisation and the order information; and applying the advertisements to the zones in response to the advertising information parcels and the allocation of those parcels.

Preferably, the order information contains data indicative of one or more of:

the budgeted expenditure for the advertising;

the number of advertisements required;

the geographic area in which the advertisements are to be placed; and the geographic spread of the advertisements.

Preferably also, the method is performed at a predetermined time after the placement of the application of the advertisements. More preferably, if, during the repeated performance, the advertising information varies from the preceding performance, then the method also includes applying correspondingly varied advertisements to the relevant zones. Even more preferably, the method includes removing the earlier applied advertisements prior to applying the varied advertisements.

In a preferred form, the location criterion includes data indicative of one or more of the following: global coordinates for the zone; the suburb in which the zone is located; the city in which the zone is located; the postcode of the area in which the zone is located; an intersection that is adjacent to the zone; and other landmarks adjacent to or near the zone.

Preferably also, the premium criterion includes a weighting for determining the cost to the respective party of placing the advertising in the respective zone for a predetermined unit of time. More preferably, the weighting is also responsive to one or more of the location criterion.

According to a sixth aspect of the invention there is provided a method for funding a first party to maintain a road, the method including:

having a second party obtain an advertising information parcel that is indicative of a visual advertisement;

having a third party provide order information to the second party to place the visual advertisement;

crediting an account with a payment from the third party to the second party;

defining a zone on a surface of the road for receiving the advertisement;

modifying the surface in accordance with the parcel to provide the visual advertisement; and debiting the account with a payment to the first party.

Preferably, the third party provides the order information to the second party.

Preferably also, the payment to the first party is calculated in response to one or more of:

the payment from the third party to the second party;

one or more characteristics of the zone;

a flat fee; and a flat fee for a given time period.

In a preferred form, the characteristics of the zone include one or more of:

the location of the zone;

the traffic flows through the zone; and the size of the zone.

According to a seventh aspect of the invention there is provided a method of placing visible advertising on a surface of a road, the method including:

determining a location at which the advertising is to be applied to the surface of the road;

determining a perspective that the viewer will have of the location; and applying the advertising to the surface such that the effect of the perspective is reduced.

According to an eighth aspect of the invention there is provided a method for providing advertising to an advertiser, the method including:

obtaining advertising information from the advertiser;

applying visible advertising to a surface of a road in response to the advertising information;

obtaining a weighting that is indicative of the traffic flows on the road; and being responsive to the weighting for determining a time cost for the advertising.

Preferably, weighting is obtained prior to the application of the advertising to the surface. However, in other embodiments, the weighting is obtained following the application of the advertising to the surface.

According to a ninth aspect of the invention there is provided a method of advertising including applying advertising information to the surface of a road.

Preferably, the advertising information is applied to the surface as a coating. More preferably, the coating is of paint. Even more preferably, the advertising information is applied to the surface as a plurality of coatings, where the coatings are of visually distinct colours.

Preferably also, the coatings are semi-permanent.

According to a tenth aspect of the invention there is provided an advertisement that results from the method of the ninth aspect.

According to an eleventh aspect of the invention there is provided a method for funding a first party to create a road, the method including:

having a second party obtain an advertising information parcel that is indicative of a visual advertisement;

having a third party provide order information to the second party to place the visual advertisement;

crediting an account with a payment from the third party to the second party;

creating a road having a surface for receiving the advertisement;

modifying the surface in accordance with the parcel to provide the visual advertisement; and debiting the account with a payment to the first party.

According to a twelfth aspect of the invention there is provided a method of advertising, the method including:

selecting a road having a plurality of adjacent lanes, wherein the lanes support respective flows of traffic in a predetermined direction;

selecting advertising zones in each of the lanes; and applying advertising information to the zones.

Preferably, the selection of the advertising zones is done in accordance with the second aspect of the invention.

Preferably also, the zones in adjacent lanes are offset from each other.

BRIEF DESCRIPTION OF THE DRAWINGS

Preferred embodiments of the invention will now be described, by way of example only, with reference to the accompanying drawings in which.

DESCRIPTION OF THE PREFERRED EMBODIMENTS

Figure 1:
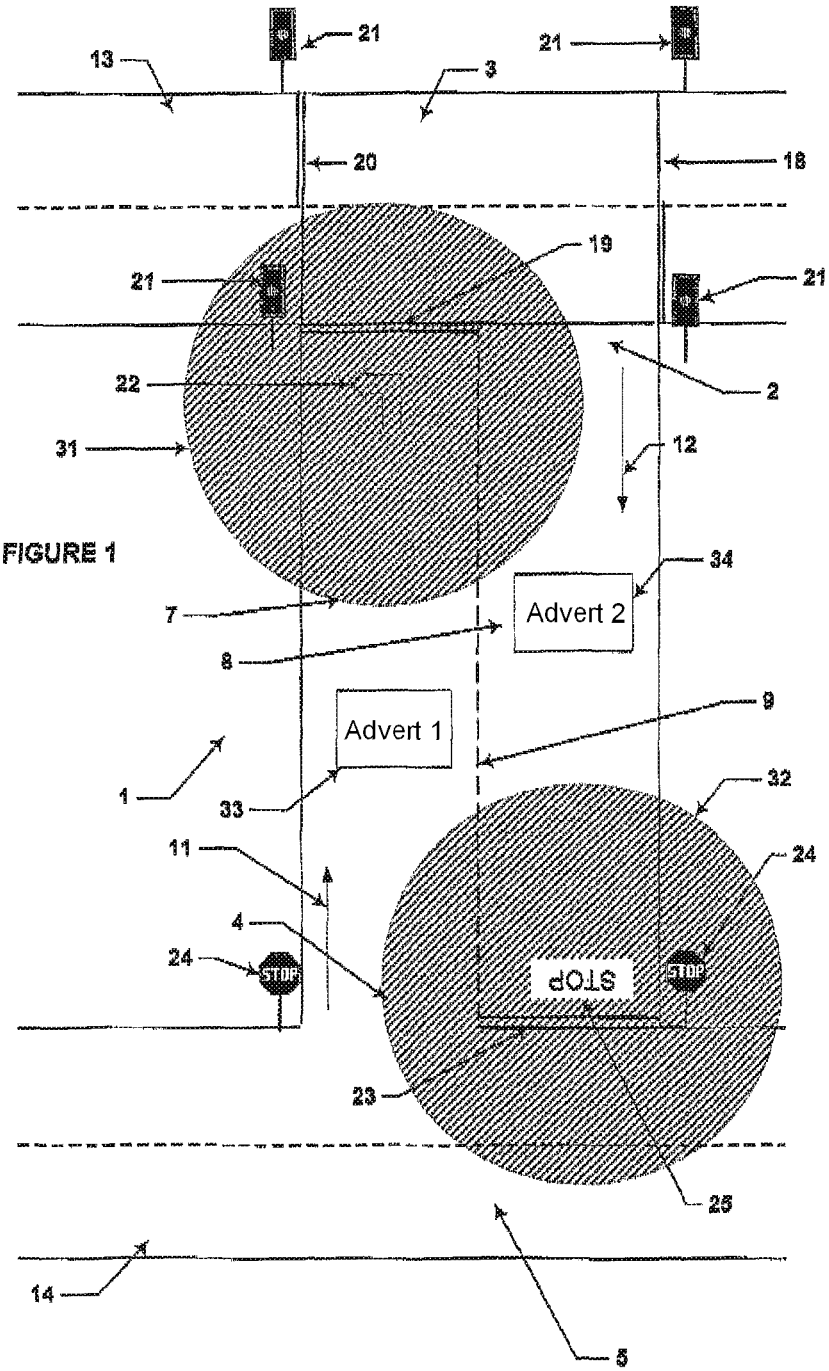
FIG. 1 is a schematic top view of a road to which advertising has been applied in accordance with an embodiment of the present invention.

Referring to FIG. 1 there is illustrated a road 1 that extends between a first end 2 that is adjacent to a first intersection 3 and a second end 4 that is adjacent to a second intersection 5 that is spaced apart from intersection 3. Intersections 3 and 5 define respective decision zones, in that the driver of a vehicle on the road approaching either of these intersections must make a decision about the direction and/or the timing of subsequent travel.

Road 1 includes two coextending and coextensive lanes 7 and 8 that are divided by a broken line marking 9. Road 1 is intended for use by vehicular traffic such as motor cars, trucks, buses and motorcycles. However, in other embodiments the road is for other traffic such a bicycles, horse drawn conveyances and, in some cases, foot traffic.

Traffic flows along lane 7 and 8 in directions indicated by respective arrows 11 and 12. These directions are opposite and correspond to the convention of traffic keeping to the left of road 1. In other embodiments used in jurisdictions where the convention is to keep to the right of road 1, the direction of travel in each of the lanes is reversed (not shown). It will be appreciated that the preferred embodiments are equally applicable to adjacent lanes having the same direction of travel.

Intersection 3 defines the interface between road 1 and a road 13 that is normal to road 1. Intersection 5, on the other hand, is an interface between road 1 and a road 14 that is also normal to road 1. In other embodiments the angle between road 1 and roads 13 and 14 is other than 90°.

Intersection 3 is collectively defined by three unbroken lines 18, 19 and 20. Lines 18 and 20 are parallel with each other and extend across road 13, while line 19 is normal to lines 18 and 20 and extends across end 2 of road 1. The traffic flow through the intersection is controlled by traffic lights 21 and a traffic control sign in the form of a left arrow 22. The arrow is painted to the surface of lane 7, adjacent to end 2, and indicates to the traffic in lane 7 that is approaching intersection 3 that only a left turn is permitted at the intersection.

Intersection 5 includes a single set of double unbroken lines 23 that extend across lane 8 at end 4. Adjacent to end 4 are two traffic control signs in the form of stop signs 24 that are posted on the side of road 1. Signs 24 indicate to the traffic in lane 8 that, upon approaching intersection 5 there is a need, in addition to giving way to any traffic travelling on road 14, to come to a complete halt prior to entering intersection 5.

Lane 8 also includes a traffic control sign in the form of a stop sign 25 that is painted to the surface of the lane. This provides the traffic with additional warning of the nature of the decision making that will soon be required.

A preferred embodiment of the invention provides a method of placing visible advertising on the upper surface of road 1. This method includes determining the location of the traffic control signs that are applied to the surface of the road. In this case, that includes determining the location of signs 22 and 25. Following from this, two exclusion zones are defined, as indicated by circles 31 and 32. These zones extend from the respective signs and terminate at a predetermined minimum distance from the signs. Advertising is then applied to the surface such that it overlies neither the signs nor the exclusion zones.

In this embodiment the advertising has been placed in the areas bounded by rectangles 33 and 34, which are respectively disposed within lanes 7 and 8. In other embodiments the advertising is placed in one of the lanes only. However, in further embodiments, rectangles 33 and 34 are adjacent to each other—as opposed to being offset—and a single advertisement extends across both rectangles.

The predetermined minimum distance is 50 metres, which equates to about three seconds of travel at the posting speed limit. That is, in this embodiment, the posted limit is 60 km/hr. In other embodiments the minimum distance is defined by five seconds of travel at the posted limit, while in further embodiments the minimum distance is set at a fixed amount of 100 metres.

The exclusion zones provide a sufficient interval between the advertising and any traffic control signs to ensure that the person controlling the relevant vehicle will have adequate time to react to those signs. More over, the absence of the advertising will act as a reminder to the person to undertake a review of the motoring environment.

The rectangles 33 and 34 bound those areas in which the advertising is placed. However, the advertising itself need not be rectangular in shape. Each rectangle 33 and 34 contains one or more separate advertisements depending upon the size of those advertisements and the rectangles.

Figure 2:
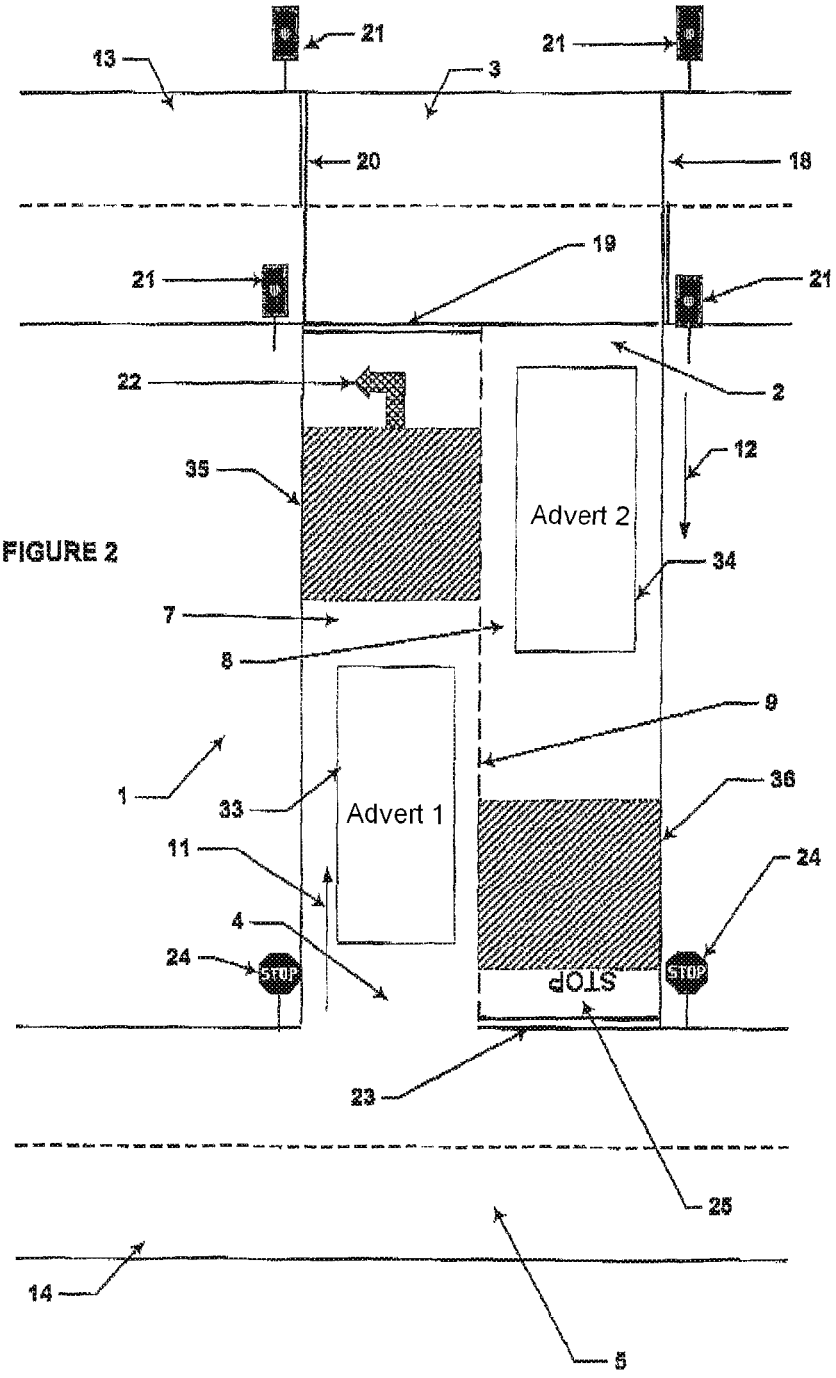
FIG. 2 is a schematic top view of a road to which advertising has been applied in accordance with an alternative embodiment of the present invention.

An alternative embodiment of the invention is illustrated in FIG. 2, where corresponding features are denoted by corresponding reference numerals. In this embodiment, the exclusion zones extend only in the lane in which the sign is applied and are designated as zones 35 and 36. Moreover, those zones extend only in the opposite direction to the direction of travel in that lane. Accordingly, it is possible to have a larger area 33 and 34 available to bear advertisements.

Figure 3:
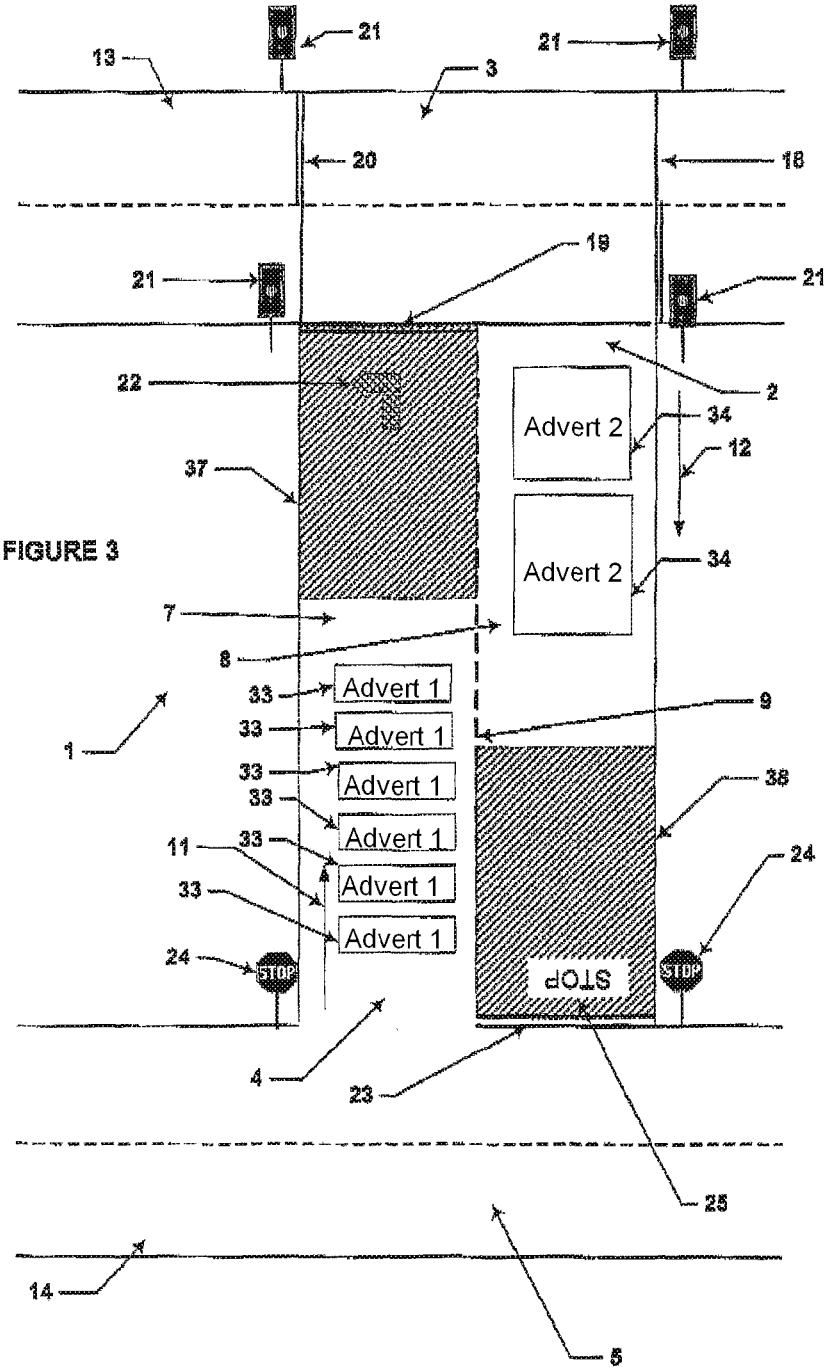
FIG. 3 is a schematic top view of a road to which advertising has been applied in accordance with a further embodiment of the present invention.

A further embodiment of the invention is illustrated in FIG. 3, where corresponding features are denoted by corresponding reference numerals. In this embodiment, the exclusion zones 37 and 38 extend from decisions zones—that is, from intersections 3 and 5—and in a direction opposite to the direction of travel in a lane. That is, the marking on the lanes that provides the reference point for the minimum distance is now the double lines 19 and 23 respectively. In this embodiment the predetermined minimum distance is larger than for the earlier described embodiments to ensure that any traffic control signs applied to the lanes fall within the respective exclusion zones.

As shown, area 33 is broken into a plurality of like sub-areas that are equally spaced apart along lane 7 in the direction of travel. This allows a number of different advertisements to be provided in the respective sub-areas or, alternatively, a single advertisement to be repeated. It also allows an advertiser to place a sequence of advertisements.

Area 34 is also sub-divided, although into only two sub-areas. In other embodiments different degrees of sub-division are used.

Another embodiment of the invention will now be described with reference to FIG. 4. Again, corresponding features have been denoted with corresponding reference numerals. This aspect provides a method of selecting portions of road lanes 7 and 8 for placing visible advertising. The method includes:

determining a direction of travel of traffic along lane 7;

determining the location of two consecutive decision zones along lane 7, wherein the zones are spaced apart in the direction of travel to define an upstream zone and a downstream zone;

defining a lead zone that extends from the downstream zone toward the upstream zone and that terminates at a first predetermined distance from the downstream zone;

selecting a first portion to lie between the upstream zone and the lead zone; and repeating the above steps for lane 8.

These steps will be described in more detail below.

The first step of determining the direction of travel is easily achieved. In this embodiment, the direction of travel in lane 7 is indicated by arrow 11. Once that is established, the next step is to determine the location of two consecutive decision zones along lane 7. In this case, those zones are defined by intersections 3 and 5. The intersections are spaced apart in the direction of travel and define an upstream zone—that being intersection 5—and a downstream zone—that being intersection 3.

It is then necessary to define a lead zone that, in this embodiment, is marked with cross-hatching and designated by reference numeral 41. Zone 41 extends from intersection 3 toward intersection 5 and which terminates at a first predetermined distance from intersection 3. The first predetermined distance is indicated by arrow 42 and is calculated in accordance with the posted speed limit.

Next, there is selected a portion of lane 7 that lies between intersection 5 and zone 41. In this embodiment, that portion is denoted by reference numeral 33.

The above steps are repeated for lane 8, with the notable distinction being that intersection 3 and 5 define the upstream zone and downstream zone respectively. This being due to the opposite direction of travel in the two lanes. This results in the portion denoted by reference numeral 34 being selected. Similarly, there is a lead zone 43 and a predetermined distance 44.

Areas 33 and 34 are smaller than the available area between the zones 41 and 43. However, in other embodiments the areas and the zones are equal in size.

Figure 4:
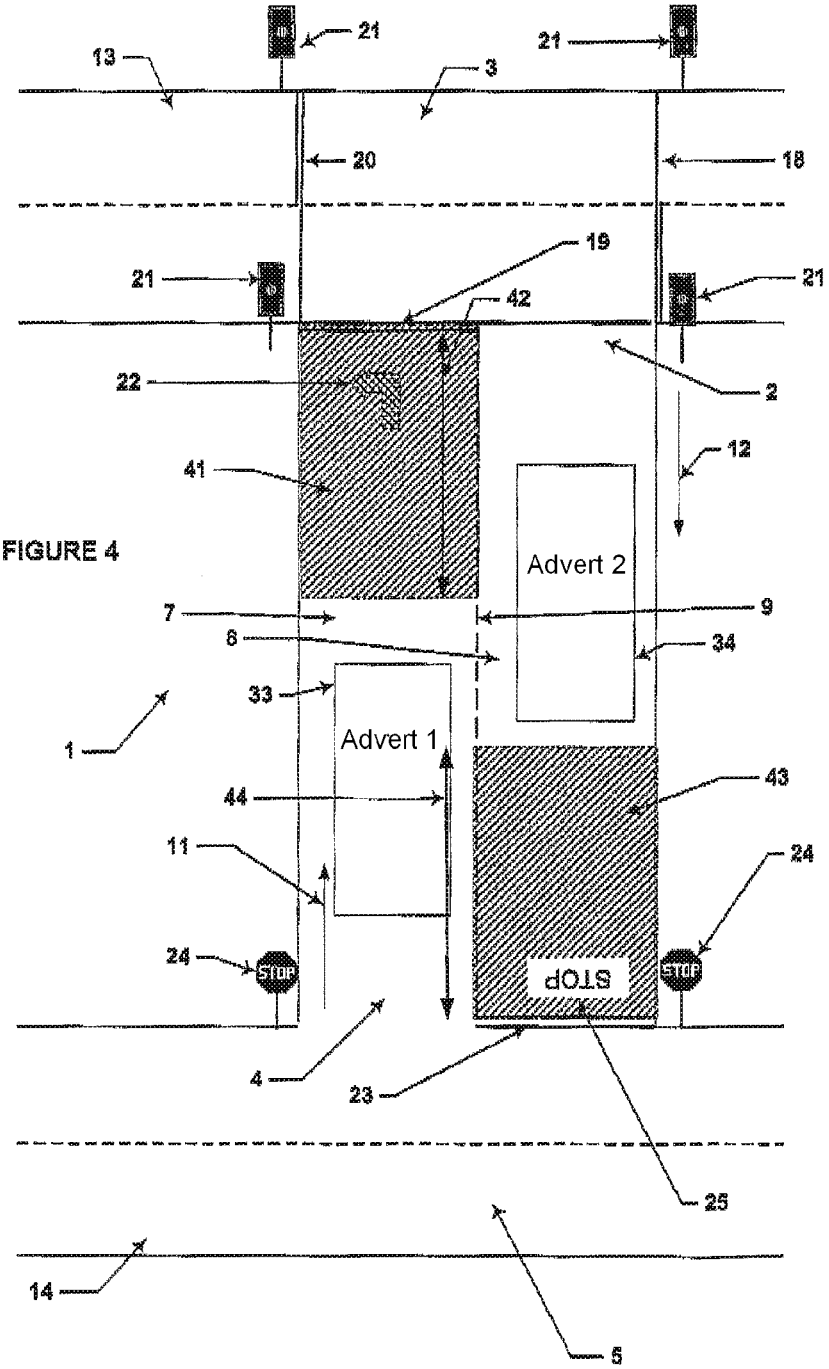
FIG. 4 is a schematic top view of a road from which has been selected a portion for placing visible advertising in accordance with the present invention.
Figure 5:
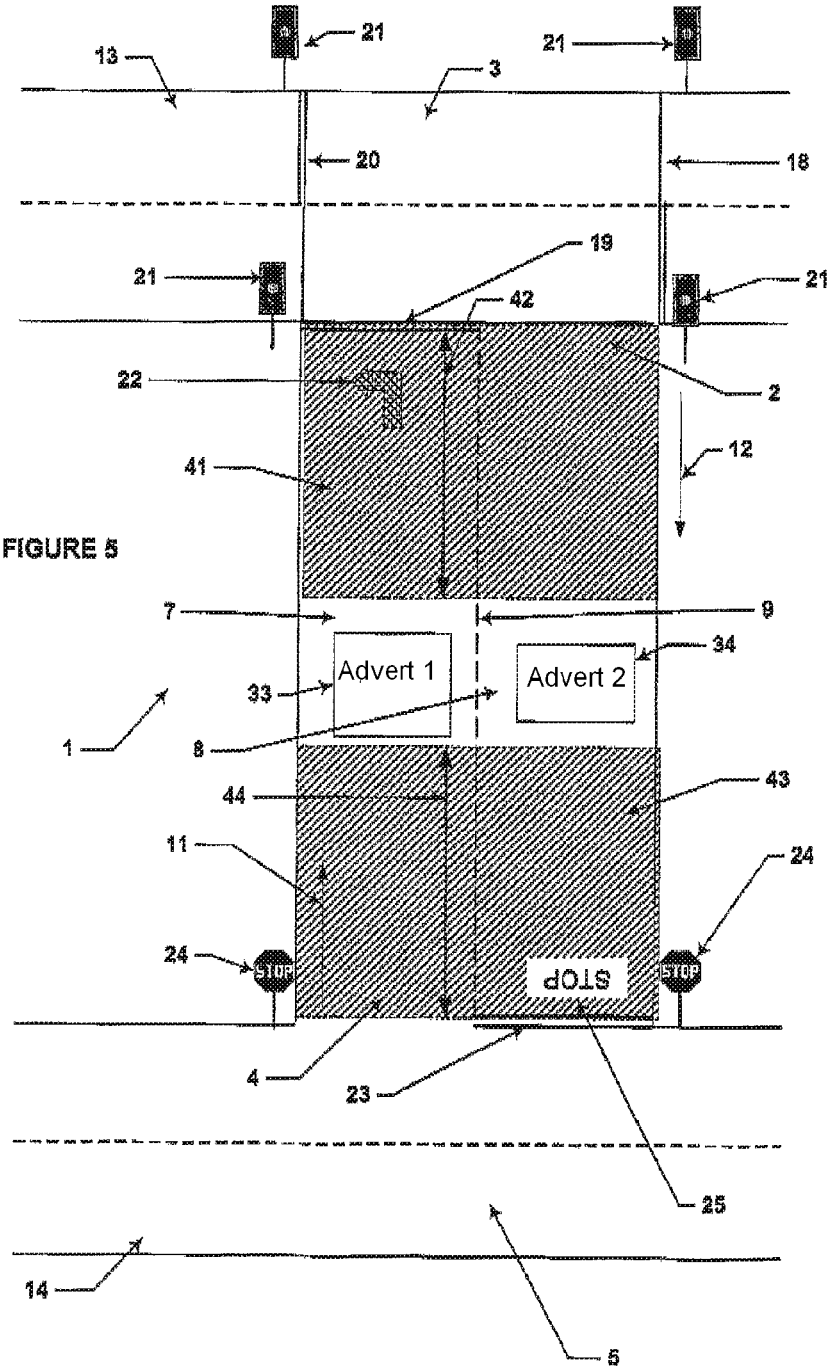
FIG. 5 is a view similar to FIG. 4 showing an alternative embodiment of the invention.

A further embodiment, similar to that of FIG. 4, is shown in FIG. 5. In this embodiment the lead zones extend across the entirety of road 1 and not just the respective lane. Accordingly, there is less total area of advertising 33 and 34. However, in some circumstances this is preferred due to local conditions.

Figure 6:
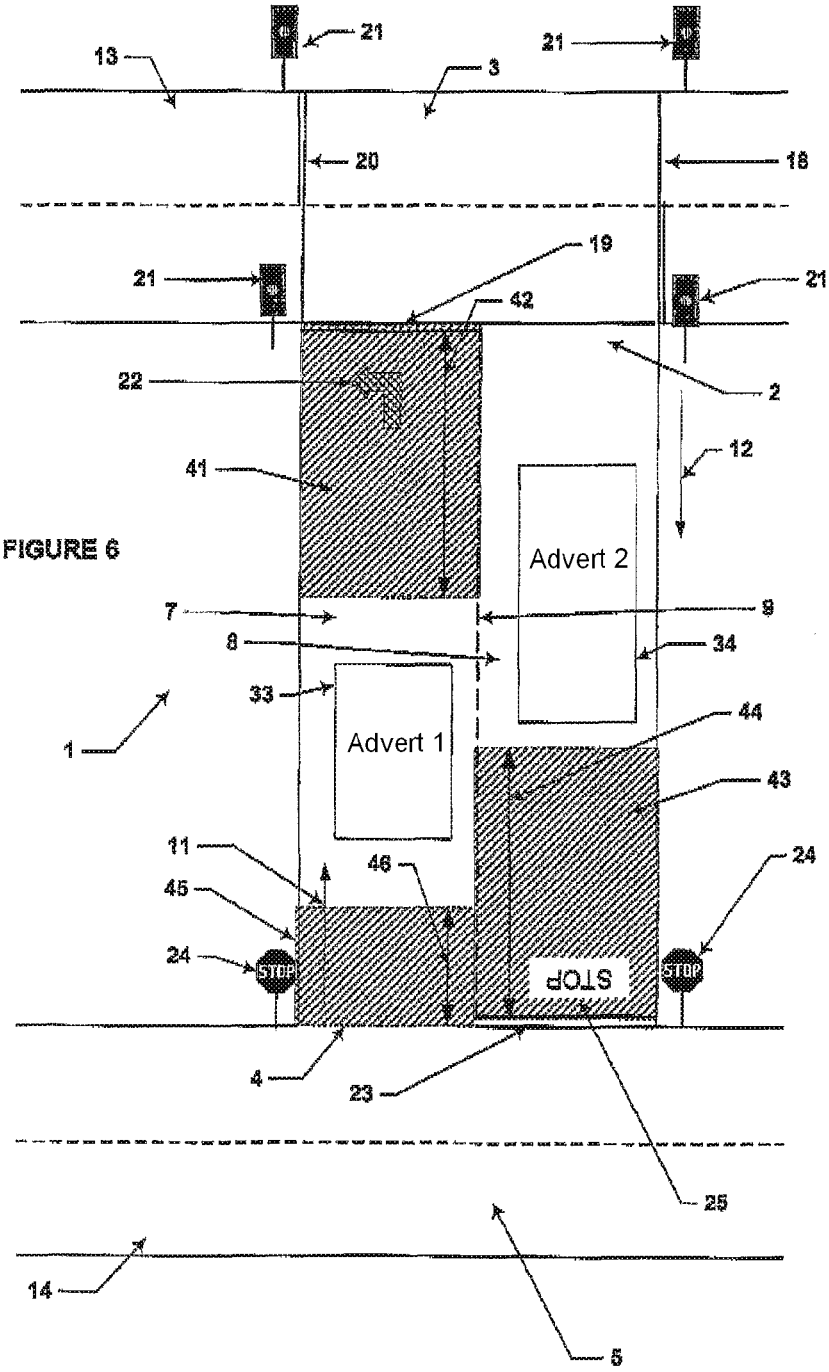
FIG. 6 is the embodiment of FIG. 4 including the additional step of defining a trailing zone for one of the lanes.

Another embodiment of the invention is shown in FIG. 6, where corresponding features are denoted by corresponding reference numerals. In this embodiment, the method also includes determining a trailing zone 45 that extends from intersection 5 toward intersection 3 and terminates at a second predetermined distance—denoted by arrow 46—from intersection 5. The area within zone 45 is excluded from selection for the placement of advertising. Distance 46 is less than distance 42 and distance 44 as it follows, not precedes an intersection. In some embodiments, however, distance 46 is equal to distances 42 and 44.

Figure 8:
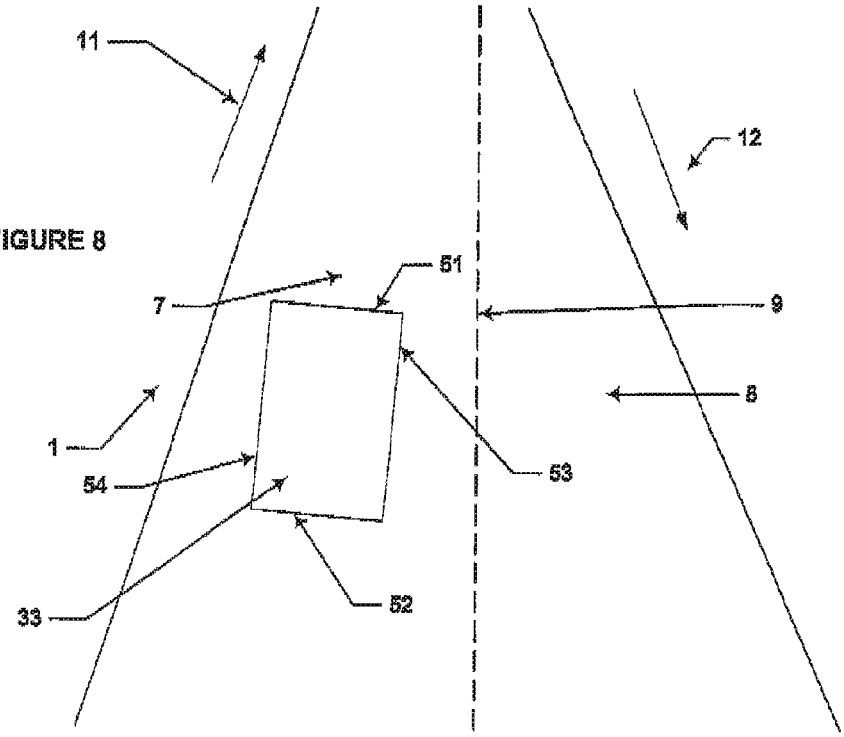
FIG. 8 is a schematic perspective view of a road to which has been applied the advertising of FIG. 7.
Figure 7:
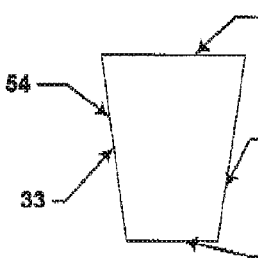
FIG. 7 is a schematic top view of a perspective corrected advertisement according to the invention.

FIGS. 7 and 8 illustrate an embodiment of the invention that relates to perspective correction of the advertisement. That is, most viewers of the advertisements will have a perspective view that is at only a small angle to the surface to which that advertisement is applied. To provide ease of viewing of that advertisement, the preferred embodiments include a correction to the advertising image to account for the typical viewing angle. Accordingly, the advertisement 33, when viewed from directly above, and as best shown in FIG. 7, will have a wide end 51 and a narrow end 52 that are joined by inclined sides 53 and 54. When this advertisement is applied to the road, as best shown in FIG. 8, it will be perceived by a viewer in a much more linear form.

At many intersections, particularly those that are controlled by traffic lights, it is usual for inductive loop sensors to be installed within the road to detect the presence or absence of cars. Accordingly, use is made of these sensors to provide an indication of the traffic density and, hence, the exposure gained by the advertisements placed in accordance with the preferred embodiments. This allows the advertiser to gain quantifiable feedback on the effectiveness or otherwise of the advertising.

In other embodiments use is made of other means for determine traffic densities and volumes in predetermined zones of the roads. This information is used as one of the inputs to determine the cost levied to the advertiser for placement of an advertisement in the respective zone.

While the preferred embodiments are targeted toward main road with traffic flows in the order of 5,000 to 100,000 cars a day, it is equally applicable to niches such as slower traffic zones—particularly adjacent to shopping centres—taxi ranks such as those at airports and hotels, and other transport interchanges.

The embodiments referred to above are applicable to road surfaces of any gradient although, as will be discussed below, some image correction will be advantageously applied, particularly for steep gradients.

In some embodiments, the advertising is applied to the surface by way of painting. However, in other embodiments, use is made of adhesive films, other films such as electrostatic films, coloured articles embedded in the surface such as glass or concrete beads, amongst other things. Additionally, other embodiments make use of coatings that reflect light back toward the source of that light. Accordingly, in the preferred embodiments, more than one advertisement is able to be placed in one area, in that viewers from one direction will perceive an image differing from viewers from the opposite direction. Other embodiments make use of active devices to provide the advertising image on the road surface. For example, the use of an array of LED's that are embedded in the surface and which include a protective cover. In other embodiments, use is made of a light source that interacts specifically with the passive coating to provide the desire visual affect. For example, ultraviolet lighting and fluorescent paint that is responsive to such lighting.

Most preferably, the advertising does not include any visual representation of numbers to minimise any confusion with the speed limit that applies to the road. Additionally, the embodiments are visually and spatially distinguished from road control signs and decision zones to minimise confusion on behalf of the motorist.

The preferred embodiments of the invention include one or more of the following advantages:

1. The motorist's attention is not diverted from the road, even to view the advertisements;
2. The advertisements offer a useful gauge to the motorist as to the distance they should remain behind any preceding vehicles;
3. The advertisement—in those embodiments without the perspective correction—will follow the contour and curvature of the surface to which it is applied. This will distort the image and allow the person controlling the vehicle to more accurately anticipate the effect of that surface upon the vehicle;
4. The absence of advertisement within a fixed distance before and/or following a traffic control sign will alert the driver to the need to make a decision about further progress;
5. The advertisement is able to be repeated at a suitable distance to enable the viewer to receive the information whilst not unduly reducing speed or altering driving behaviour;
6. The advertising as a whole is modular and easily segmented for different advertisers;
7. The advertising space is able to be bought and traded separately from the road itself;
8. Through use of directional reflective systems, such as optically transparent beads, the reflection of the incident light is tuned to maximise driver focus and to minimise advertising to non-target audiences or to having advertising impinging upon areas of reverence such as churches or areas such as schools, hospitals and the like;
9. The design of the advertisements occurs separately from the road and allows tailored adaptations to specifically accommodate local conditions;
10. Provide an increased degree of visibility of the road, and the advertisement conveyed, in a multitude of conditions including low light such as at night and during severe weather conditions. This allows a focusing the viewer's attention, the conveying of the relevant information successfully and a maximising of safety conditions.
11. It enables the viewer to sight the advertisement whilst continuing to perform tasks such as driving with maintenance of proper control. Driving along the road requires vigilant attention and therefore a method to aid the focus of the driver's attention to the road surface is of the utmost importance.
12. Advertisements are positioned on the road surface at different angles so as to produce street advertising selectively focused for drivers, pedestrians, building workers or other classes of viewers.
13. Different roads are in various states of repair, therefore the placement of advertising upon a road will allow the condition to be visualised with greater ease. This will facilitate not only the driver's assessment of the condition but will also encourage the various parties to properly maintain the road.

Figure 10:
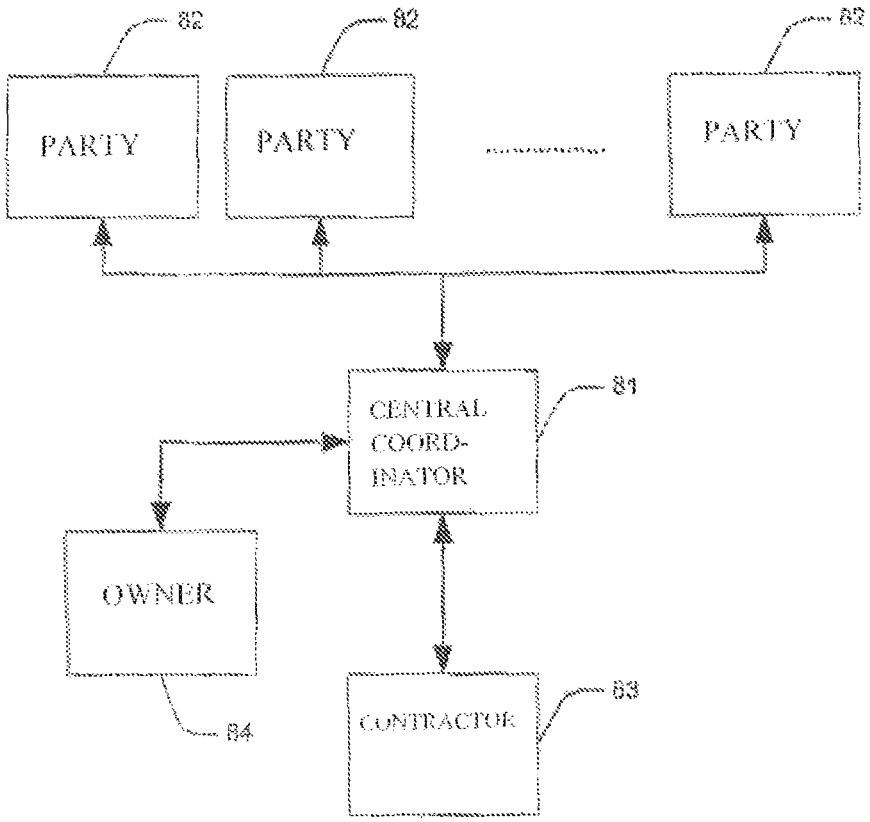
FIG. 10 is a schematic representation of a further embodiment of the invention.

A further preferred embodiment of the invention is schematically illustrated in FIG. 10, and includes a method of advertising on a road surface. The method includes a central coordinator 81 obtaining a plurality of advertising information parcels in electronic form that are indicative of corresponding visual advertisements from one or more or a plurality of parties 82. These parties are typically either providers of goods and/or services, or advertising agents acting on behalf of such providers. In any event, parties 81 desire to have advertisements placed upon the road surface to advertise respective products and/or services. Each information parcel includes an image file of a predetermined format, and this varies between jurisdictions. In all cases, the resolution of provided by the format must be sufficient to allow the image to be replicated by the equipment that is ultimately used to place the advertisement on the road.

Coordinator 81 confirms receipt of the respective parcels and conducts an initial quality control review of the information parcel to ensure that the image contains subject matter that is suitable for application to a road. For example, if the image is complex and contains significant amounts of information or writing, it is less likely to be cognised by a driver. In such cases, coordinator 81 provides feedback to the respective party.

Parties 82 communicate with coordinator 81 by a secure internet link (not shown). However, in other embodiments, use is made of other media, be that electronic, paper based, voice, or a combination.

The information parcels are accompanied by order information from the respective parties for placement of the visual advertisements. The order information contains data fields for allowing the parties 82 to indicate one or more of: the expenditure that the party 82 has budgeted for the advertising; the number of advertisements required; the geographic area in which the advertisements are to be placed; and the geographic spread of the advertisements. These fields are processed by coordinator 81 to formulate a road advertising campaign for party 82, as will be discussed further below.

Coordinator 81 has available a predefined quantum of road surface that is available to bear advertisements such as those desired by parties 82. This road surfaces is defined as a plurality of zones (not shown) for receiving respective advertisements. Each zone is characterised by coordinator 81 by the following criterion: location; size; maximum allowable speed; time period; and premium. In other embodiments, less criterion are used, while in other embodiments additional or different criterion are used.

The location criterion, in this embodiment, includes data indicative of: global coordinates for the zone; the suburb in which the zone is located; the city in which the zone is located; the postcode of the area in which the zone is located; an intersection that is adjacent to the zone; and other landmarks adjacent to or near the zone. Additionally, the premium criterion includes a weighting for determining the cost to the respective party 82 of placing the advertising in the respective zone for a predetermined unit of time. More preferably, the weighting is also responsive to one or more of the location criterion.

With the zones characterised in this way, it is possible to create a database of available zones to automate the allocation of those zones in response to the order information from parties 82. Clearly, with a limited resource, there will be circumstances where party 82 will not be able to immediately place advertising in a desired zone. Where this occurs, coordinator 81 undertakes further processing to identify an alternative zone that best satisfies the requirements of that party. For some parties 82, if a desired zone is not immediately available, it is reserved for use when it does so become available.

Coordinator 81 undertakes the above processing electronically and automatically through use of a computer network (not shown) that is interfaced with parties 82 via the internet. That processing results in a confirmation of an order and invoice being electronically delivered to the respective party wishing to place the advertisements. This confirmation includes all the relevant information about the location of the advertisement, the content of the advertisement, the timing and duration of the placement and the cost to the party of that placement. Simultaneously or contemporaneously with the delivery of the confirmation being sent to a respective party 82, coordinator 81 also automatically generates an electronic instruction to a contractor 83 who is charged to physically place the advertisement or advertisements in the agreed location. Accordingly, the electronic instruction is response to the advertising information parcels and the allocation of those parcels.

Contractor 83 undertakes the necessary action to have the advertisement or advertisements placed, and upon doing so, provides an electronic confirmation that this has occurred. In some embodiments, this confirmation includes a field containing a digitised image of the advertisement. Coordinator 81 is responsive to this confirmation for undertaking a selective quality review of the advertisements, and for providing the image to the respective party 82.

The above method is performed repeatedly at predetermined times after the placement and application of the advertisements. If, during one of these repeated performances, the advertising information varies from the preceding performance, then the method also includes applying correspondingly varied advertisements to the relevant zones. More preferably, the method includes removing the earlier applied advertisements prior to applying the varied advertisements. Ultimately, this will depend upon the actual form of the modification that is provided to the road surface to affect the advertisements.

Coordinator 81 gathers data indicative of the traffic densities at least selected ones of the zones, and uses this as a means of determining the quantum of the charges levied to respective parties 82 who place advertisements within those zones. In some cases, the advertisers will be prepared to pay a premium for high volume exposure, in addition to certain geographic factors. In some embodiments, the data is historical, and is provided by manual estimates or counts. However, it is preferred that the data is gathered from the period in which the advertisement is placed, and is gathered automatically. For example, through use of inductive loop or other sensors near or within the road itself. This allows the advertiser with greater objectivity of exposure, and to allow another measure to correlate with the results of a marketing campaign involving the advertisements.

The above method also includes additional steps that involve the owner of the road. In this embodiment is has been assumed there is only one owner 84, although it will be appreciated that in other embodiments there is more than one owner.

Coordinator 81 generates revenues from the placement of advertising on the road surface and pays contractor 84 to place those advertisements. Additionally, the coordinator provides payments to owner 84 which are then able to be used to contribute to the ongoing maintenance of the roads under the control of owner 84. It is in the interests of coordinator 81 to have a road surface in good repair, as otherwise parties 82 will be less inclined to place advertisements. Accordingly, coordinator 81, in addition to the above steps, makes use of contractor 83 to gain information about the state of the roads where advertisements are desired to be placed. This information is provided to coordinator 81 in an electronic form and, in cases where maintenance or preventative maintenance is warranted, the required information is electronically and automatically sent to owner 84. As the coordinator has accurate records of the zones, it is possible for the owner to be easily informed of the timing and location of any potential sites of wear or disrepair.

As contractor 83 is already set up for electronic communication with coordinator 81, there is very little additional capital expense involved in including this additional functionality.

Accordingly, this embodiment provides a method for funding a first party—that is, owner 84—to maintain a road. In a broad form, the method includes having a second party in the form of coordinator 81 obtain an advertising information parcel that is indicative of a visual advertisement. A third party, in the form of party 82, provides order information to the second party to place the visual advertisement. In response, an account is credited with a payment from the third party to the second party. Then, as described above, a zone is defined on a surface of the road for receiving the advertisement, and the surface is modified in accordance with the parcel to provide the visual advertisement. Next, the account is debited with a payment to the first party.

The third party provides the order information to the second party, and the payment to the first party is calculated in response to one or more of:

the payment from the third party to the second party;

one or more characteristics of the zone;

a flat fee; and a flat fee for a given time period.

In this embodiment, the characteristics of the zone include one or more of:

the location of the zone;

the traffic flows through the zone; and the size of the zone.

According to another embodiment, there is provided a method of advertising including applying advertising information to the surface of a road. The advertising information is applied to the surface as a coating and, preferably, as a coating of paint. In some cases, the advertising information is applied to the surface as a plurality of coatings, where the coatings are of visually distinct colours. The coatings are semi-permanent.

Preferential use is made of passive materials such as paint due to cost and safety considerations. The material used has to be sufficiently robust to withstand that wear of vehicle traffic, but also be removable to allow the application of a fresh or different advertisement. It is possible to use active devices such as LED's embedded in the surface of the road.

While the embodiment described above is applicable to assisting in the funding f the maintenance of a road, it will also be appreciated that it is applicable to the creation of a road. Accordingly, in another embodiment, there is provided a method for funding a first party to create a road, the method including:

having a second party obtain an advertising information parcel that is indicative of a visual advertisement;

having a third party provide order information to the second party to place the visual advertisement;

crediting an account with a payment from the third party to the second party;

creating a road having a surface for receiving the advertisement;

modifying the surface in accordance with the parcel to provide the visual advertisement; and debiting the account with a payment to the first party.

While the above description has been primarily directed toward the application of advertisements within a single lane, in other embodiments the advertisement are applied to a multi-lane road. Accordingly, it is possible to describe such embodiments, in broad terms, as providing a method of advertising, where the method includes:

selecting a road having a plurality of adjacent lanes, wherein the lanes support respective flows of traffic in a predetermined direction;

selecting advertising zones in each of the lanes; and applying advertising information to the zones.

Preferably, the zones in adjacent lanes are offset from each other. In those embodiments where that is not the case, the resultant multi-lane advertisement is large enough for the motorist in each lane to view the advertisement without being distracted or diverted from the traffic or traffic conditions.

In those embodiments where the advertising is applied to the road surface in the form of a paint of other coating, the method of application includes the use of a template. The template is a sheet of laminate material that has had portions removed to define windows through the material. The shape and spacing of the windows correspond to the shape and spacing of the desired information contained within the advertising. Alternatively, the windows define a negative of the desired information contained within the advertising.

The template is placed upon the selected road surface and the paint or other coating applied over the template. The paint will pass through the windows and onto the road below to provide the appropriate representation. It will be appreciated that the image need not fully cover all of the surface, and the underlying road colour is able to be used as a background colour. In some embodiments, particularly those used on road with higher speed limits, the preference is to include less rather than more detail to better ensure cognisance of the information being advertised. This tends to favour the use of logos and trademark devices over text. Notwithstanding, text is able to be used either alone or in combination with a logo.

In some embodiments, a number of templates are used in sequence in the same selected road surface to allow the use of paints of more than one colour. While it is usual for the windows of different templates to be offset, in other embodiments, some of the windows overlap to allow mixing of the paints in selected areas and therefore a greater number of colours are achieved with the same number of paint colours.

In the preferred embodiment, the templates are provided by the advertiser to the party applying the advertising. However, in other embodiments, the advertiser provides advertising information that is subsequently converted into templates.

It is understood that certain geographic locations will be more highly valued by advertisers than others, and a premium will be paid for the use of that location. The value placed upon a location by an advertiser will be dependent upon many factors, some of which have been foreshadowed above. An additional factor will be any nearby features of the road surface. For example, a particular car manufacturer may place a slightly higher value on the road adjacent to the sales site of a rival manufacturer, and may be prepared to pay a premium for advertising on that road surface. For zones that are deemed to be premium zones, or where there is intense competition to advertise in a zone, use is made of an auction or tendering system to best ensure that a market rate is paid.

The paint or paints used with the templates is intended to be removed at the end of a predetermined period—which is, in this embodiment, a calendar month—and is chosen to be easily removable after that length of application to the road. Some paints are removed through abrasion such as brushing or scaping, while other paints are removed with solvents. In some embodiments, a combination of abrasion techniques and solvents are used. Alternative embodiments simply apply the new advertisement over the old or, in other cases, paint over the old with a background colour upon which the new advertisement is then painted.

Figure 9:
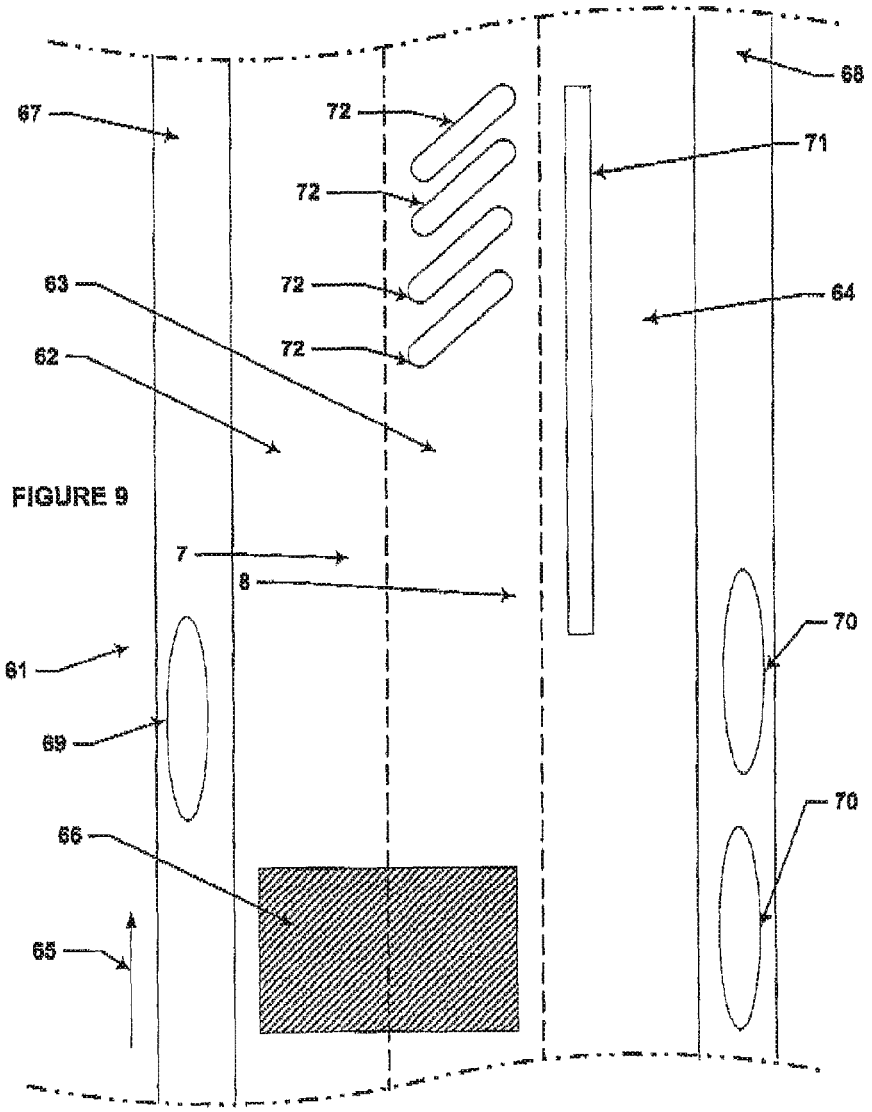
FIG. 9 is a schematic top view of an embodiment of the invention as applied to a freeway.

The preferred embodiments have been described above with particular reference to use in built up areas where the decision zones and traffic control zones are closely spaced. However, it is also applicable to open roads such as country roads and freeways where the decision zones and traffic control zones are spaced further apart. For example, in the embodiment illustrated in FIG. 9, the area selected to apply the advertisements is on a multi-lane freeway 61. While only one side of the freeway is illustrated, it will be appreciated that the other side will support traffic flows in the opposite direction. That is, all the traffic in the three lanes 62, 63 and 64 travels in the direction shown by arrow 65. With multi-lane roads such as freeway 61, it is possible to have a single advertisement, such as advertisement 66, overlapping a number of lanes. Moreover, because of the longer distances between decision zones it is possible for an advertiser to place a series of advertisements at regular intervals (not shown). It is envisaged that at a freeway speed of 110 km/hr, that a series of advertisements placed at 10 km intervals—that is, at just over 5 minutes travelling time—will provide the motorist with a timely reminder of the advertised product, as well as encouraging the motorist to maintain their focus upon the road. This is particularly advantageous for government advertising relating to safe travel, to the advertising of petrol stations and restaurants along the freeway, and to other advertisers with an interest in promoting products and services while also encouraging safe travel.

Freeway 61 also includes two opposite shoulders 67 and 68 that run adjacent to lanes 62 and 64 respectively. These shoulders also have respective advertisements 69 and 70 applied to their surfaces. It will be noted that these advertisements are other than rectangular. As a further illustration of the alternative shape, orientation and configuration of the advertising, lane 64 is shown to include an advertisement 71 that is elongate in the direction of travel and which only occupies less than half the width of the lane. Other alternatives include a series of inclined advertisements 72 that are placed within lane 63. Many other shapes, configurations and orientations are available, including irregular and compound shapes that present an image of a logo or other distinctive device.

The advertising is applicable to all road surfaces, be they bitumen, concrete, or other materials.

In some embodiments, the advertising is applied as a coating or film that has high grip levels. In some cases, the coating is a coloured particulate material and a binder for adhering the material to the surface of the road. The texture of this material is usually coarser than the underlying road surface and allows better grip, especially in the wet.

Alternative materials for modifying the road surface to provide the advertisements include concrete, coloured or textured gravels, or adhesive tapes. One particularly preferred material is a high friction skid resistance surface treatment sold under the trademark TYREGRIP AS by an Australian company Safe T Surfaces Pty Ltd. Other treatments provided by this entity are also suitable. At the date of lodgement of this specification the details of those products were included on the website www.tyregrip.com.au.

The actual treatment, coating, or other material used to ensure the road surface provides a predetermined visual image to the desire viewer is dependent upon a variety of physical factors such as the nature of the surface, the prevailing weather conditions and the traffic density, amongst others. However, it is also dependent upon the regional laws about what forms of surface modifications to roads is permissible. There is considerably variety between jurisdictions and, typically, is administered and regulated by a government or semi-government body. For example, in the state of New South Wales, Australia, the relevant body is known as the Roads and Traffic Authority. This leads, in some cases, to the relevant body specifying or indeed supplying the permissible materials for treating the road surface.

In embodiments where use is made of coloured concrete, or beads within the concrete, the information to displayed is of a relatively permanent nature. However, where the advertising is applied to the road surface as a coating, that coating is designed to degrade with time. This is in recognition of the changing needs of the parties wishing to advertise, and the fact that they will not wish to indefinitely pay for an advertisement in a given location. It therefore also allows the use of less expensive materials, as permanence is not required. It usually also facilitates the removal of the material, should that be required, say, prior to placing a new advertisement in the same location. In the present embodiments, an advertisement is designed to have an effective lifetime of about three months.

The degradation of the material is dependent upon the density, speed and size of the traffic on the road, the prevailing whether conditions and the material used in the coating. Accordingly, the rate of degradation is determined individually for different roads and different coatings. Once the advertisements are placed it will progressively decay. In some embodiments, such as the particulate example used above, the binder breaks down with exposure to air and, as such, the particulate will remain tolerant to traffic flows for some time, but then will quickly be removed by the traffic once the binder fails.

It is also envisaged that advertisements placed in accordance with the invention will have preferential areas for wear, where underlying that area is a further image or information. That is, the advertisement will change with time to reveal the underlying advertisement.

In some embodiments, the surface is modified by the projection of light through a filter. The end result being a predetermined image being formed on the surface, where that image is an advertisement. This is particularly advantageous in areas where snow, water, leaves or other matter is known to periodically or regularly lie on the surface and thereby render directly surface mounted advertising ineffective. In these embodiments, the "road" includes the intervening Particularly in built up areas, a road usually terminates at its transverse edges in respective opposite gutters. Extending transversely beyond the gutters are footpaths that are also typically sealed surfaces. As will be appreciated by those skilled in the art, these footpaths are intended to bear predominantly pedestrian traffic. Notwithstanding, the advertising and method of advertising of the invention is applicable also to these surfaces.

The term "road" is intended to refer to a path travelled by vehicular or other traffic. This includes a street, a footpath or sidewalk, a carriageway, dual or otherwise, a thoroughfare, a highway, a freeway, an artery, a bridge, an alley, a cul-de-sac and the like. The surface of the road is preferably sealed to facilitate the application of the advertisement.

The preferred embodiments make use of a load bearing surface of the road to also display advertising information to the party travelling on that surface. This dual functionality provides many advantages and benefits, as enunciated above.

Although the invention has been described with reference to specific examples, it will be appreciated to those skilled in the art that the invention may be embodied in many other forms.

The invention claimed is:

1. A method of placing visible advertising on a surface of a road for vehicular traffic, the method comprising steps of:

determining a location of one or more traffic control signs for the vehicular traffic that are applied to the surface, wherein the traffic control signs are positioned at or adjacent to an intersection of two or more roads and the traffic control signs relate to traffic control of vehicles approaching the intersection;

defining exclusion zones on the surface that extend respectively from the signs and that terminate at a predetermined minimum distance from the signs;

applying a coating to the surface to define the advertising, wherein, in use, the advertising overlies neither the signs nor the exclusion zones and is subject to wear by the vehicular traffic; and at a predetermined period after applying the coating, removing from the surface substantially all of the coating remaining on the surface.

2. A method according to claim 1, wherein the road is subject to a maximum speed limit, and wherein the method further comprises a step of calculating a predetermined minimum distance in response to the maximum speed limit.

3. A method of selecting a portion of a road lane for placing visible advertising, the method comprising steps of:

determining a direction of travel of vehicular traffic along the lane;

determining locations of two consecutive decision zones along the lane, wherein the zones are associated with an intersection of two or more roads and are spaced apart in a direction of travel to define an upstream zone and a downstream zone;

defining a lead zone that extends from the downstream zone toward the upstream zone and that terminates at a first predetermined distance from the downstream zone;

selecting the portion to lie between the upstream zone and the lead zone;

applying a coating to a surface of the selected portion to define the advertising, wherein, in use, the advertising is subject to wear by the vehicular traffic; and at a predetermined period after applying the coating, removing from the surface substantially all of the coating remaining on the surface.

4. A method according to claim 3, further comprising steps of:

determining a maximum allowable speed of the traffic along the lane; and calculating the predetermined distance based on the maximum allowable speed.

5. A method according to claim 4, wherein the step of calculating the predetermined distance includes multiplying the maximum allowable speed by a constant time factor.

6. A method according to claim 5, wherein the time factor is three seconds.

7. A method according to claim 3, further comprising steps of:

determining a maximum allowable speed of the traffic along the lane; and calculating a minimum length of the advertising in the direction of travel based on the maximum allowable speed.

8. A method according to claim 3, further comprising a step of defining a trailing zone that extends from an upstream zone toward a downstream zone and that terminates at a second predetermined distance from the upstream zone.

9. A method according to claim 8, wherein the first predetermined distance and the second predetermined distance are about equal.

10. A method according to claim 3, wherein the first predetermined distance and the second predetermined distance are not equal, and the first predetermined distance is greater than the second predetermine distance.

11. A method according to claim 3, wherein the direction of travel is constant.

12. A method according to claim 3, wherein the coating is one or more of: a paint, an adhesive tape, a reflective material, and a textured material.

13. A method according to claim 3, further comprising a step of orientating the advertising within the lane for preferential viewing by a user progressing along the lane in the direction of travel.

14. A method of placing visible advertising on a surface of a road for vehicular traffic, the method comprising steps of:

determining a location of a traffic control sign for the vehicular traffic that is applied to the surface, wherein the traffic control sign is positioned at or adjacent to an intersection of two or more roads and the traffic sign relates to traffic control of vehicles approaching the intersection;

defining an exclusion zone on the surface that extends from the sign and that terminates at a predetermined minimum distance from sign;

applying a semi-permanent coating to the surface to define the advertising, wherein, in use, the advertising overlies neither the sign nor the exclusion zone; and at a predetermined period after applying the coating, removing from the surface substantially all of the coating remaining on the surface.

15. A method according to claim 14, further comprising a step of subjecting the coating to wear by vehicular traffic.

* * * * *